US005595460A

United States Patent [19]

Miller et al.

[11] Patent Number: 5,595,460

[45] **Date of Patent: * Jan. 21, 1997**

[54] MODULAR BLOCK RETAINING WALL SYSTEM AND METHOD OF CONSTRUCTING SAME

[75] Inventors: Robert A. Miller, Marietta; Philip M. Taylor, Atlanta, both of Ga.

[73] Assignee: The Tensar Corporation, Atlanta, Ga.

[ * ] Notice: The term of this patent shall not extend beyond the expiration date of Pat. No. 5,540,525.

[21] Appl. No.: 370,324

[22] Filed: Jan. 10, 1995

Related U.S. Application Data

[63] Continuation-in-part of Ser. No. 254,710, Jun. 6, 1994, Pat. No. 5,540,525.

[51] Int. Cl.[6] ..... E02D 29/02

[52] U.S. Cl. ..... 405/284; 405/286; 52/605

[58] Field of Search ..... 405/258, 272, 405/284, 286; 403/364, 374, 380; 52/605

[56] References Cited

U.S. PATENT DOCUMENTS

| | | | |
|---|---|---|---|
| 60,253 | 1/1922 | McConville . | |
| D. 250,484 | 12/1978 | Muse | D25/87 |
| D. 279,030 | 5/1985 | Risi et al. | D25/80 |
| D. 280,024 | 8/1985 | Risi et al. | D25/80 |
| D. 284,308 | 6/1986 | Risi et al. | D25/91 |
| D. 299,069 | 12/1988 | Risi et al. | D25/157 |
| D. 301,063 | 5/1989 | Risi et al. | D25/113 |
| D. 305,938 | 2/1990 | Risi et al. | D25/113 |
| D. 320,088 | 9/1991 | Risi et al. | D25/113 |
| D. 340,293 | 10/1993 | Risi et al. | D25/113 |
| D. 341,432 | 11/1993 | Risi et al. | D25/113 |
| D. 346,031 | 4/1994 | Risi et al. | D25/114 |
| D. 350,611 | 9/1994 | Scales | D25/114 |
| 991,722 | 5/1911 | Hourd . | |
| 1,751,272 | 7/1927 | Forman . | |
| 1,992,785 | 2/1935 | Steuer . | |

(List continued on next page.)

FOREIGN PATENT DOCUMENTS

| | | | |
|---|---|---|---|
| 2075580 | 2/1994 | Canada . | |
| 0079880 | 5/1983 | European Pat. Off. . | |
| 481435 | 9/1921 | France . | |
| 2755833 | 7/1978 | Germany . | |
| 144014 | 6/1991 | Japan | 405/284 |
| WO85/03535 | 8/1985 | WIPO . | |

OTHER PUBLICATIONS

Minislope® System, "An Easy, Elegant Alternative!" (installation guide, pp. 1593 and 1594) Permacon.

*Primary Examiner*—John A. Ricci

*Attorney, Agent, or Firm*—Jacobson, Price, Holman & Stern, PLLC

[57] ABSTRACT

A modular wall block is formed with a trough or recess in a top surface configured to frictionally receive fingers of a rake-like grid connection device. The fingers are engaged through apertures in an end portion of a grid-like sheet of material with the spine of the rake overlying the grid-like sheet of material, the remainder of the grid-like sheet of material extending rearwardly to reinforce the fill behind a retaining wall formed from a plurality of courses of the wall blocks. Slat members are selectively received in one of a pair of grooves defined in each side of the wall blocks with portions of the slats extending above the upper surface of the block to contact a surface of an opening formed in a superimposed block for positioning the front faces of the blocks in the retaining wall relative to each other in either a vertically aligned or rearwardly offset relationship. The slats also include portions projecting laterally from the sides of the block and spanning the space between adjacent blocks in a course of blocks to position juxtaposed blocks in each course relative to each other. Alternatively, the rake includes, in addition to fingers projecting downwardly from the spine, tabs projecting upwardly from the spine. The tabs engage a slot in a bottom of the wall block for positioning, depending upon the direction of extension of the tabs, the front faces of the blocks in the retaining wall relative to each other in either a vertically aligned or vertically offset relationship.

41 Claims, 11 Drawing Sheets

U.S. PATENT DOCUMENTS

| | | | |
|---|---|---|---|
| 2,201,110 | 5/1940 | Makram . | |
| 3,379,017 | 4/1968 | Kusatake . | |
| 3,461,631 | 8/1969 | Brugnola . | |
| 3,609,926 | 10/1971 | Muse . | |
| 3,686,873 | 8/1972 | Vidal . | |
| 4,031,678 | 6/1977 | Schuring . | |
| 4,068,482 | 1/1978 | Hilfiker . | |
| 4,123,881 | 11/1978 | Muse . | |
| 4,186,540 | 2/1980 | Mullins | 52/593 |
| 4,273,476 | 6/1981 | Kotulla et al. | 405/258 |
| 4,440,527 | 4/1984 | Vidal | 405/284 |
| 4,470,728 | 9/1984 | Broadbent | 405/284 |
| 4,815,897 | 3/1989 | Risi et al. | 405/284 |
| 4,824,293 | 4/1989 | Brown et al. | 405/284 |
| 4,952,098 | 8/1990 | Grayson et al. | 405/284 X |
| 5,028,172 | 7/1991 | Wilson et al. | 405/286 |
| 5,044,833 | 9/1991 | Wilfiker | 405/284 X |
| 5,044,834 | 9/1991 | Janopaul, Jr. | 405/284 |
| 5,064,313 | 11/1991 | Risi et al. | 405/284 |
| 5,066,169 | 11/1991 | Gavin et al. | 405/284 |
| 5,122,015 | 6/1992 | Shen | 405/284 |
| 5,131,791 | 7/1992 | Kitziller | 405/286 |
| 5,145,288 | 9/1992 | Borcherdt | 405/284 |
| 5,154,542 | 10/1992 | Klenert | 405/286 |
| 5,248,226 | 9/1993 | Risi et al. | 405/284 |
| 5,257,880 | 11/1993 | Janopaul | 405/284 |
| 5,417,523 | 5/1995 | Scales | 405/284 |

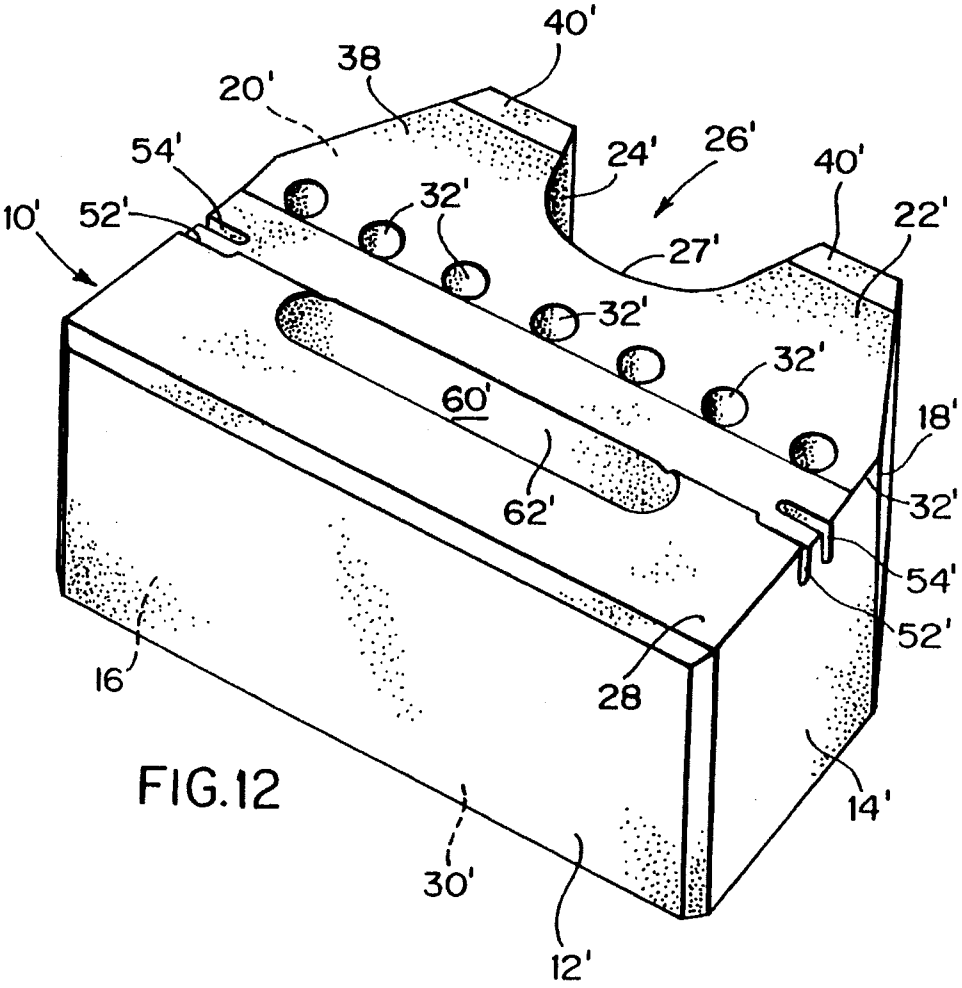
FIG.12
FIG. 10
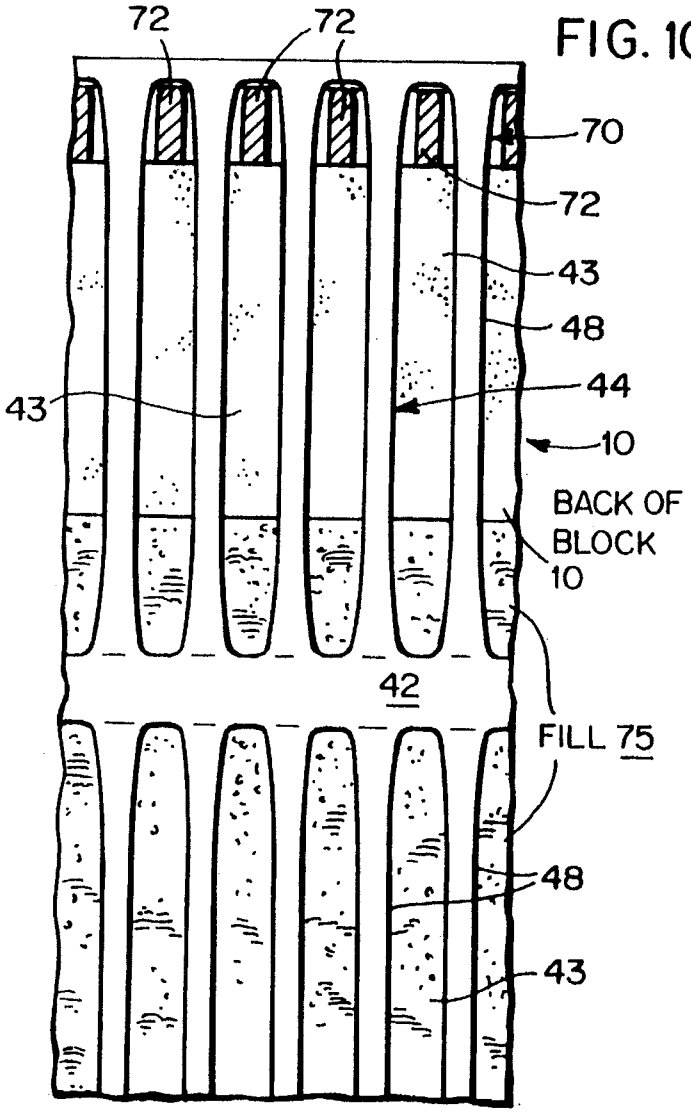

28"
52"
54"
32"
38"
40"
22"
102
104
120
112
110
17
108
122
114
116
124
d
c
126
128
42"
43"
48"
44"

MODULAR BLOCK RETAINING WALL SYSTEM AND METHOD OF CONSTRUCTING SAME

This application is a continuation-in-part of application Ser. No. 08/254,710, filed Jun. 6, 1994 now U.S. Pat. No. 5,540,525.

FIELD OF THE INVENTION

This invention relates to a modular wall block system, and more particularly, to a modular wall block system incorporating unique means to mechanically secure extended lengths of grid-like sheets of material to selected courses of such wall blocks used to form a reinforced retaining wall or the like. Additionally, the wall blocks of this invention are designed for ease in positioning and locating individual blocks relative to each other during construction of such civil engineering structures.

BACKGROUND OF THE INVENTION

Retaining walls are commonly used for architectural and site development applications. The wall facing must withstand very high pressures exerted by backfill soils. Reinforcement and stabilization of the soil backfill is commonly provided by grid-like sheet materials that are placed in layers in the soil fill behind the wall face to interlock with the wall fill soil and create a stable reinforced soil mass. Connection of the reinforcing material to the elements forming the wall holds the wall elements in place and resists soil backfill pressures.

A preferred form of grid-like tie-back sheet material used to reinforce the soil behind a retaining wall structure, known as an integral geogrid, is commercially available from The Tensar Corporation of Atlanta, Georgia ("Tensar") and is made by the process disclosed in U.S. Pat. No. 4,374,798 ("the '798 patent"), the subject matter of which is incorporated herein in its entirety by reference. However, other forms of grid-like tie-back sheet materials have also been used as reinforcing means in the construction of retaining walls, and the instant inventive concepts are equally applicable with the use of such materials. In any event, difficulties are encountered in providing a secure interconnection between the reinforcing means and the wall elements, especially in areas of high earthquake (seismic) activity.

In a brochure entitled "Concrete Geowall Package", published by Tensar in 1986, various retaining wall structures are shown using full height cast concrete panels. In one such retaining wall structure short strips, or tabs, of geogrid material, such as shown in the '798 patent, are embedded in the cast wall panels. On site, longer strips of geogrid are used to reinforce the wall fill, creating a stable soil mass. To connect the geogrid tabs to the reinforcing geogrid, the strands of one portion of geogrid are bent to form loops, the loops are inserted between the strands of the other portion of geogrid so that the loops project out of the second portion of geogrid, and a rod is passed through the loops on the opposite side of the second portion to prevent the loops being pulled back through, thereby forming a tight interconnection between the two portions of geogrid, sometimes referred to as a "Bodkin" joint.

Use of full height pre-cast concrete wall panels for wall-facing elements in a retaining wall requires, during construction, that the panels be placed using a crane because they are very large, perhaps 8 by 12 feet or even larger and, as a result, are quite heavy such that they cannot be readily manhandled. To avoid such problems in the use of pre-cast wall panels other types of retaining wall structures have been developed. For example, retaining walls have been formed from modular wall blocks which are typically relatively small as compared to cast wall panels. The assembly of such modular wall blocks usually does not require heavy equipment. Such modular wall blocks can be handled by a single person and are used to form retaining wall structures by arranging a plurality of blocks in courses superimposed on each other, much like laying of brick or the like. Each block includes a body with a front face which forms the exterior surface of the formed retaining wall.

Modular wall blocks are formed of concrete, commonly mixed in a batching plant with only enough water to hydrate the cement and hold the unit together. Such blocks may be commercially made by a high-speed process which provides a mold box having only sides, without a top or bottom, positioned on top of a steel pallet which contacts the mold box to create a temporary bottom plate. A concrete distributor box brings concrete from the batcher and places the concrete in the mold box and includes a blade which levels the concrete across the open top of the mold box. A stripper/compactor is lowered into the open, upper end of the box and contacts the concrete to imprint the block with a desired pattern and compresses the concrete under high pressure. The steel pallet located at the bottom of the mold box resists this pressure.

A vibrator then vibrates the mold box to aid in concrete consolidation. After approximately two to four seconds, the steel pallet is moved away from the bottom of the mold box which has been positioned above a conveyor belt. The stripper/compactor continues to push on the formed concrete to push the modular wall block out of the mold box onto the conveyor belt. This process takes about seven to nine seconds to manufacture a single wall block. The formed wall block is cured for approximately one day to produce the final product.

With this high-speed method of construction, it is not practical to embed short strips or tabs of grid-like material or the like in the blocks with portions extending therefrom in the manner of the pre-cast wall panels shown in the Tensar brochure, in order to enable interconnection with a grid-like reinforcing sheet material directly or by a Bodkin-type connection or the like. Therefore, other means for securing the reinforcing grid to selected modular blocks used to construct a retaining wall have had to be devised. Most such techniques actually secure end portions of a sheet of reinforcing grid between layers of wall blocks, relying primarily on the weight of superimposed blocks to provide a frictional engagement of the reinforcing means between large surface areas of superimposed wall blocks to form a retaining wall. The nature of the large surface area of cementitious wall blocks having very rough surfaces contacting the reinforcing means tends to abrade, and thereby weaken, a polymeric sheet reinforcing material at the very point of interconnection with the retaining wall. Moreover, and most importantly, reliance on the weight of superimposed blocks to provide the primary grid-to-block connection strength is ineffective during an earthquake or other such seismic event where vertical accelerations, i.e., the actual momentary lifting of upper courses of wall blocks, decrease or totally eliminate the weight of superimposed blocks, thereby significantly reducing or eliminating the connection strength and jeopardizing the stability of the retaining wall and the soil mass retained thereby.

SUMMARY OF THE INVENTION

It is a primary object of this invention to provide a simple and inexpensive modular wall block system formed of a plurality of wall blocks and a highly effective grid connection means for securing extended lengths of grid-like reinforcing sheet material to the wall blocks.

An important object of this invention is to provide a grid-to-block connection which does not rely in any significant way on the weight of superimposed courses of wall block or on a significant frictional engagement between the reinforcing grid material and the juxtaposed surfaces of the modular blocks.

A further object of this invention is the provisions of a modular wall block system for forming a retaining wall or the like incorporating a unique means which provides a secure interconnection between a grid-like reinforcing sheet material and selected wall blocks, even during seismic events such as an earthquake or the like.

Yet another object of this invention is the provision of a modular wall block retaining wall system providing a total bearing grid-to-block engagement by virtue of a rake-like or comb-like grid connection device.

Still yet another object of this invention is the provision of modular wall blocks having a positioning or locating means located in their side edges for laterally aligning in each course adjacent blocks and for cooperating with openings extending through each block to selectively position superimposed courses of the modular wall blocks with their front faces vertically aligned or offset rearwardly.

A still further object of this invention is the provision of a modular wall block retaining wall system providing a total bearing grid-to-block engagement by a rake-like or comb-like grid connection device which serves to align or stagger a front face of superimposed wall blocks while interconnecting adjacent wall blocks of a single course of wall blocks.

Still yet another further object of the invention is the provision of modular wall blocks having a positioning or locating means formed by a cooperation of a slot located at a bottom of each wall block of a course of wall blocks and a rake-like or comb-like grid connection device secured in an upper surface of a successively lower course of wall blocks.

As indicated, a preferred grid-like sheet reinforcing material may be made according to the techniques disclosed in the above-identified '798 patent. Preferably, uniaxially-oriented geogrid materials as disclosed in the '798 patent are used, although biaxial geogrids or grid materials that have been made by different techniques such as woven, knitted or netted grid materials formed of various polymers including the polyolefins, polyamides, polyesters and the like or fiberglass, may be used. In fact, any grid-like sheet material, including steel (welded wire) grids, with interstitial spaces capable of being secured to selected modular wall blocks with the rake connection device of the instant invention in the manner disclosed herein are suitable. Such materials are referred to herein and in the appended claims as "grid-like sheets of material".

According to a preferred embodiment of the instant inventive concepts, a modular wall block is formed with a trough in a portion of a recessed area in its upper surface to receive and retain the rigid rake connection device which includes a multiplicity of finger elements engaged through the grid-like sheet of material openings into frictional engagement with the sidewall portions of the block forming the trough. The frictional component of the finger elements against the concrete trough sidewalls is enhanced by serrations along the edges of the finger elements thereby securely locking the device in place.

In an alternate embodiment of the rake, extending from the spine, cross-bar or backbone element in a direction opposite to the fingers are a plurality of tabs. The tabs extend above at least some of the fingers, preferably directly above a finger, and include a common surface formed by one edge of a finger, one edge of the spine and one edge of the tab. However, each tab extends beyond an opposite edge of the spine for a distance approximately equal to a width of the spine.

The rake includes a cross-bar or backbone element interconnecting the fingers and entrapping the grid-like sheet of material by retaining geogrid between a top surface of a block and the backbone element. In this way, the grid-like sheet of material is securely retained by the wall block even in the event of a vertical acceleration of the wall elements which may occur during an earthquake or the like. While the blocks above may experience vertical acceleration, the rigid rake connector is locked into the trough of the concrete block.

The rake grid connection device may be formed of steel, aluminum, fiberglass, a plastic reinforced with fiberglass or, preferably, a high strength polymer capable of frictionally engaging the sidewalls of the wall block trough to lock the rake connection device in place thereby transferring load from the grid-like sheet of material through the fingers and crossbar of the grid connection device to the modular wall block.

As disclosed in the '798 patent, a high strength geogrid may be formed by stretching an apertured plastic sheet material. Utilizing the uniaxial techniques, a multiplicity of molecularly-oriented elongated strands and transversely extending bars which are substantially unoriented or less-oriented than the strands are formed. The strands and bars together define a multiplicity of grid openings. With biaxial stretching, the bars are also formed into oriented strands. In either event, or when using other grid-like sheet of materials, the fingers of the grid connection device are spaced apart equal to a spacing between strands of the grid-like sheet of material, but may also be spaced apart several times the spacing between strands of the grid-like sheet of material such that most but not every grid opening receives a finger through it.

At a construction site, a plurality of modular wall blocks are stacked in staggered, vertically superimposed, courses. Rake grid connection devices are secured within the troughs of wall blocks of selected blocks to capture the end portions of elongated lengths of grid-like sheet of material, the remainder of which is stretched out and interlocked with the fill soil or aggregate. The sheets of grid-like sheet of material reinforce the fill so as to create a stable mass behind the retaining wall.

A substantially 100% end-bearing mechanical interconnection is achieved between the modular block retaining wall and the extended lengths of grid-like sheet of material through the rake grid connection device without the necessity for frictionally engaging substantial portions of the grid-like sheet of material between the courses of wall block. The wall blocks are provided with a recess which receives the rake grid connection device and grid-like sheet of material, including thickened portions, if any such as the thickened bars found in a uniaxial geogrid, below the level of the upper surface of the wall block. Therefore, the strength of the connection is almost totally independent of the weight of superimposed wall blocks or friction between the wall blocks and the grid-like sheet of material which makes the connection more secure and positive, particularly in earthquake-prone sites. As noted, connections which depend upon substantial friction for their strength can also subject the material of the grid-like sheet of material to undesirable deterioration caused by the contact of the rough wall block surfaces with the grid-like sheet of material, particularly woven, knitted or netted grid-like sheet of materials.

The modular wall block of the present invention operates in conjunction with the rake connection device to achieve the enumerated benefits. The modular wall block is preferably about 7⅝ inches high, 16 inches wide at its front face, 9½ inches wide at its rear face and 11 inches deep, weighing approximately 75 pounds. The block includes a front face, a rear face, upper and lower surfaces and rearwardly converging opposed side surfaces. The aforementioned trough is formed in the upper surface for receiving the rake connection device and grid-like sheet of material, and an arcuate cut-out cooperates with a central through-hole or opening to reduce weight and provide finger engaging surfaces which facilitate lifting and placing the blocks. Side grooves are also provided for holding connector slats which laterally align adjacent blocks in each course. The connector slats also serve to cooperate with the central through-hole in each block to selectively position or locate the blocks of superimposed courses front-to-back, for forming retaining walls of various configurations such as vertically aligned or offset or stepped back front faces.

In an alternative embodiment, a slot is located at a bottom of the wall block for cooperation with tabs projecting above the spine of the rake grid connection device. In this embodiment, the side grooves for the connector slats may optionally be removed since the tabs of the rake grid connection device project into the bottom slot for relative positioning of successive courses of wall blocks.

The rake grid connection device, in the wall blocks devoid of the side slate grooves, is the only device for interconnecting adjacent wall blocks by at least three fingers of the rake grid connection device extending into an adjacent wall block. Since the length of the alternate embodiment of the grid connection is less than a width of a wall block, any excess of the rake grid connection device extending beyond the terminal end of a course of wall blocks can be snapped off.

The alternate embodiment of the rake grid connection device is preferably used on a course of wall blocks aligned in a straight row. Since the difference in width of the tabs of the rake grid connection device and the slot on the bottom of the wall block is only approximately one-fourth inch, curved walls may be interconnected by the rake grid connection device if the radius of curvature of a course of walls blocks is greater than sixty feet. Alternatively, if the connection slat grooves are maintained, the connector slats may be used on curved walls of a lesser radius of curvature.

While the modular wall block system of this invention preferably includes both the rake connection means for securing grid-like sheet of material thereto, and the side connector slats for aligning the blocks side-to-side and front-to-back, each of these features may be effectively utilized independently of the other or the connector slats and their grooves may be eliminated in favor of a rake grid connection means having projecting tabs cooperating with a slot of a bottom of a successive course of wall blocks.

The above and other objects of the invention, as well as many of the attendant advantages thereof, will become more readily apparent when reference is made to the following detailed description, taken in conjunction with the accompanying drawings.

BRIEF DESCRIPTION OF THE DRAWINGS

FIG. 10 is a fragmentary horizontal sectional view illustrating the manner in which the fingers of the foregoing rake grid connection device secure a grid-like sheet of material to the modular wall;

FIG. 12 is a schematic front perspective view of an alternative form of a modular wall block according to the instant inventive concepts;

DETAILED DESCRIPTION OF THE PREFERRED EMBODIMENTS

Figure 1:
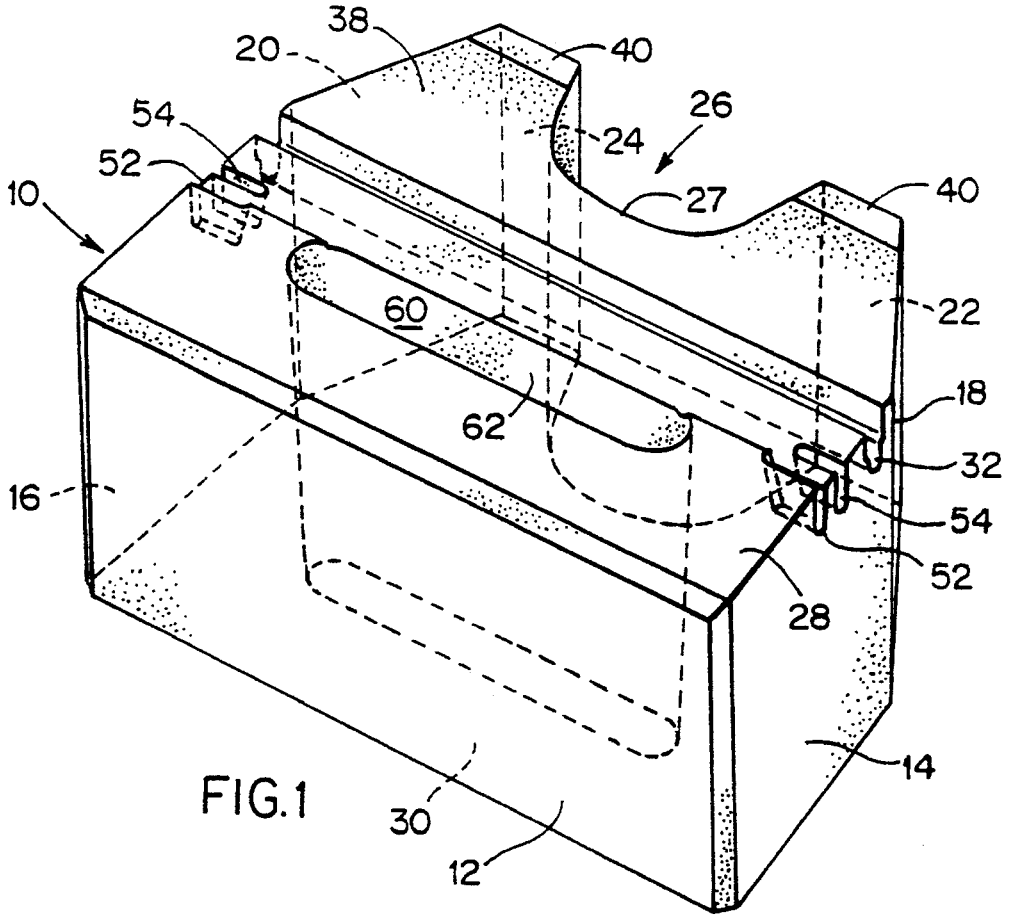
FIG. 1 is a schematic front perspective view of one form of a modular wall block according to the instant inventive concepts with dotted lines illustrative of surfaces concealed from view.

In describing preferred embodiments of the invention as illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose. Similarly, while preferred dimensions are set forth to describe the best mode currently known for the modular wall block system of this invention, these dimensions are illustrative and not limiting on the instant inventive concepts.

Further, while a retaining wall formed by assembling a multiplicity of modular wall blocks according to this invention is shown in some of the drawings as providing a vertical exterior facing surface, as is well known, succeeding courses of modular wall blocks are commonly shifted slightly rearwardly for stability and appearance. As explained in more detail below, the instant inventive concepts readily enable the construction of a retaining wall having either design. Further, while the illustrated retaining wall formed by the modular wall blocks of the invention is shown as straight, it can be curved or formed in other configurations without departing from the instant inventive concepts.

The front faces of the modular wall blocks can have any aesthetic or functional design. They can be planar, convex, concave, smooth, rough or have any configuration consistent with architectural or other requirements.

Finally, while the preferred embodiment hereof is shown and described with reference to a uniaxially-oriented polymer geogrid such as is disclosed in the '798 patent, alternative grid-like tie-back reinforcing sheet materials may be substituted therefor, including grid-like sheet materials manufactured using weaving, knitting or netting techniques and also steel (welded wire) grid.

Figure 2:
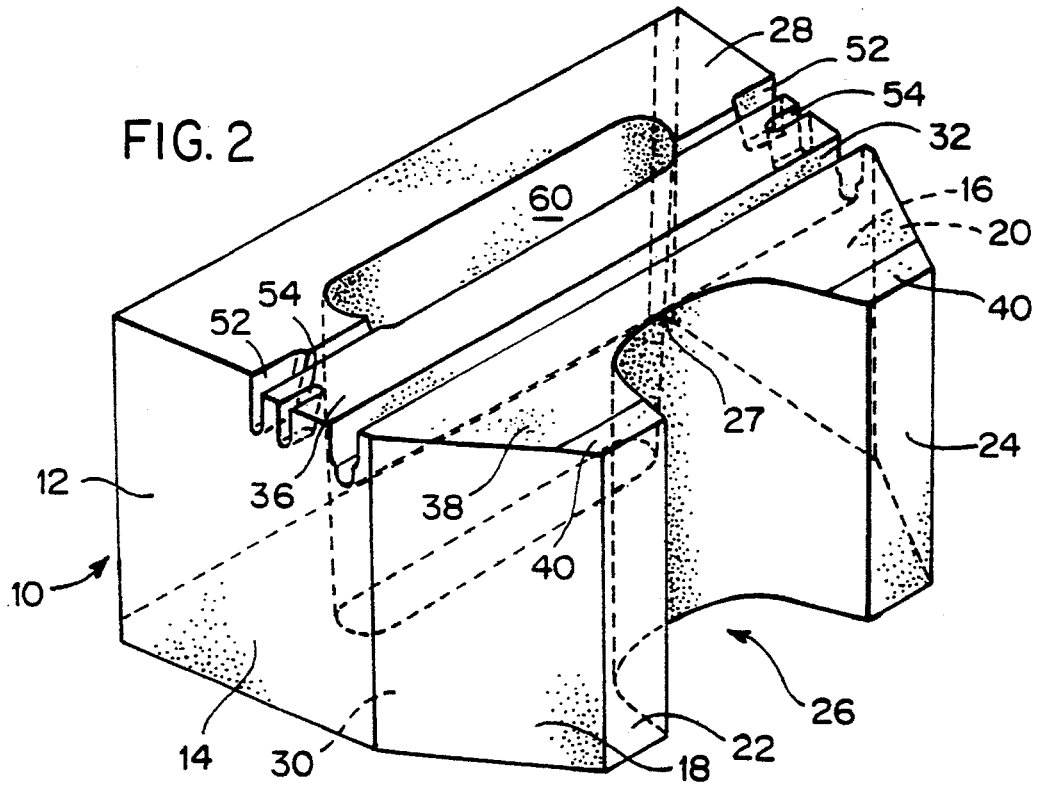
FIG. 2 is a rear perspective view thereof.
Figure 3:
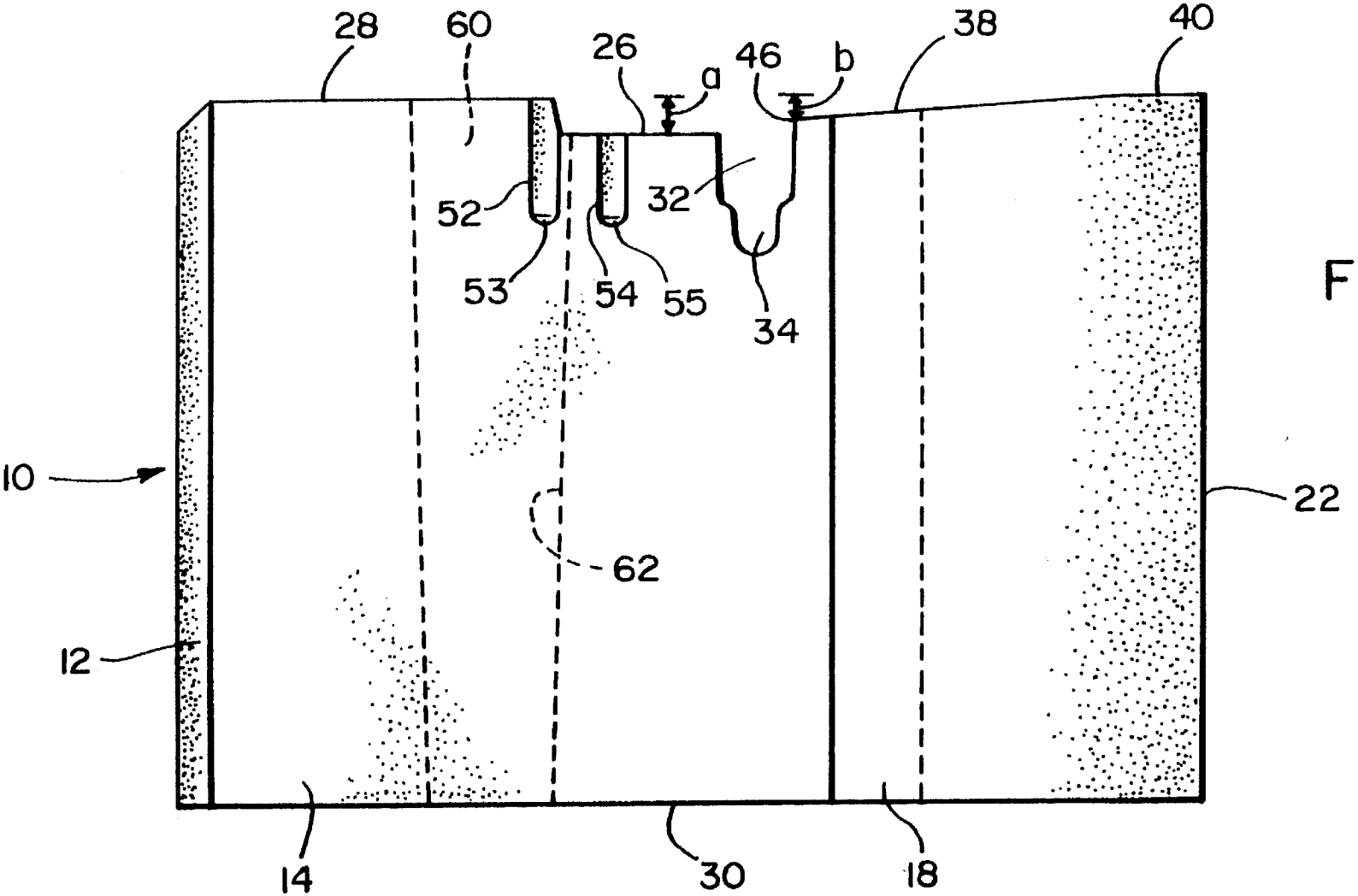
FIG. 3 is a side elevational view thereof.

With reference now to the drawings in general, and FIGS. 1 through 3 in particular, one embodiment of a modular wall block is schematically shown at 10 as comprising a front face 12, rearwardly converging sidewalls 14, 16 with more sharply converging rearward portions 18, 20, rear wall portions 22, 24 interconnected by portions defining an arcuate cut-out 26, an upper surface 28, and a lower surface 30.

An elongated trough or recess 32 preferably extends transversely across each block 10 below its upper surface 28 to frictionally receive a rake grid connection device as described further hereinafter. Preferably the trough 32 is about ⅞ inch deep and about ¾ inch wide. A gutter 34 is formed in the bottom of trough 32 to carry water to the sidewalls 14, 16.

Figure 8:
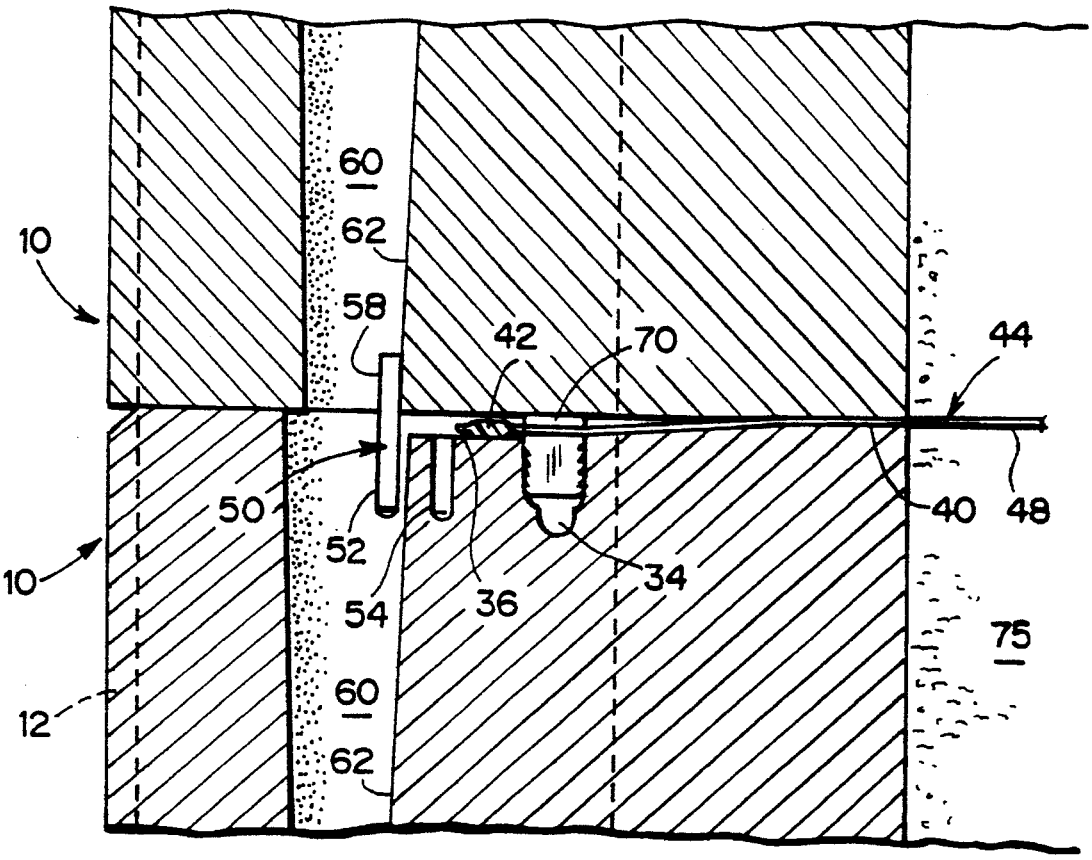
FIG. 8 is a schematic side sectional view showing the manner in which a pair of superimposed wall blocks are positioned vertically relative to each other with this embodiment, and the manner in which a grid-like sheet of material is secured to the lower block.
Figure 9:
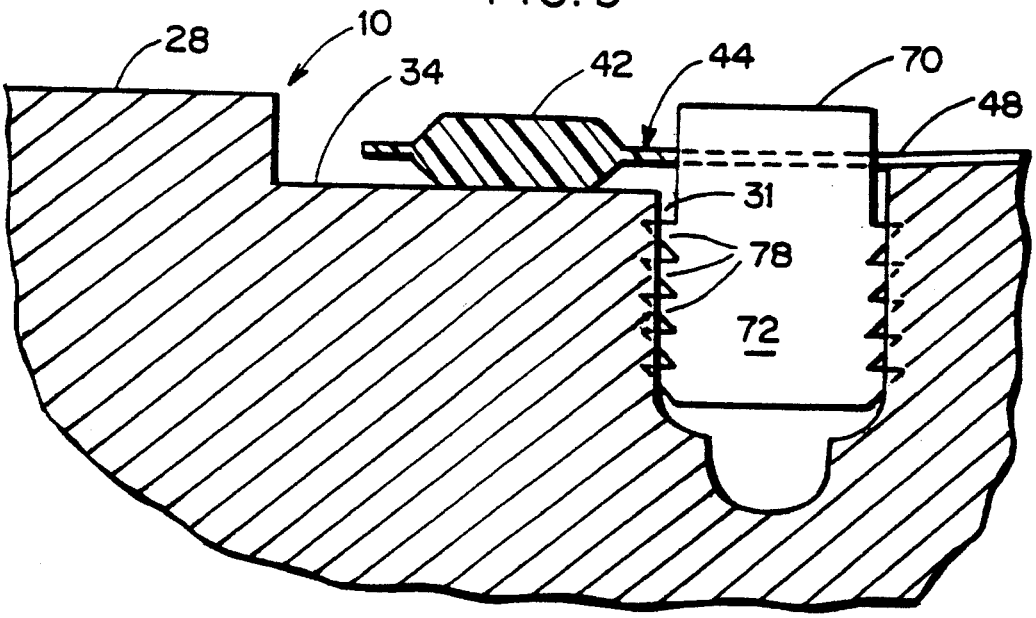
FIG. 9 is an enlarged view of a portion of the interengagement of the grid connection device in the trough of a modular wall block according to the above embodiment of the instant inventive concepts.

Forwardly of the trough 32 is an offset portion 36. Rearwardly of the trough 32 are upwardly inclined portions 38 which extend to two small flat areas 40 on either side of the arcuate cut-out 26. The offset portion 36 is preferably positioned below the upper surface 28 by height "a" equal to approximately ⅜ inch to receive a thickened bar 42 of a uniaxial geogrid or the like 44 as best seen in FIGS. 8 and 9 and upwardly inclined portions 38 are positioned below the level of upper surface 28 at its leading edge 46 by a height "b" equal to approximately 5/16 inch to accommodate the strands or fingers 48 of the geogrid 44. Thus, the only portions of the geogrid 44 engaged between the cementitious surfaces of the modular wall blocks 10 are parts of the strands 48 passing over the small flat upper surface areas 40.

Figure 4:
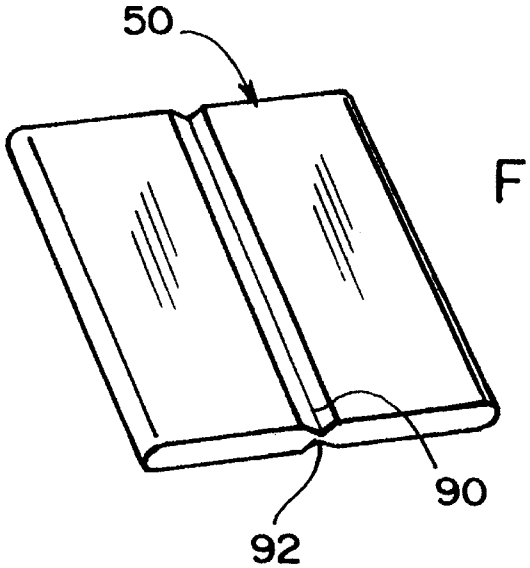
FIG. 4 is a bottom perspective view of a connector slat for laterally aligning the modular blocks side-to-side in a given course, and front-to-back in superimposed courses.
Figure 11:
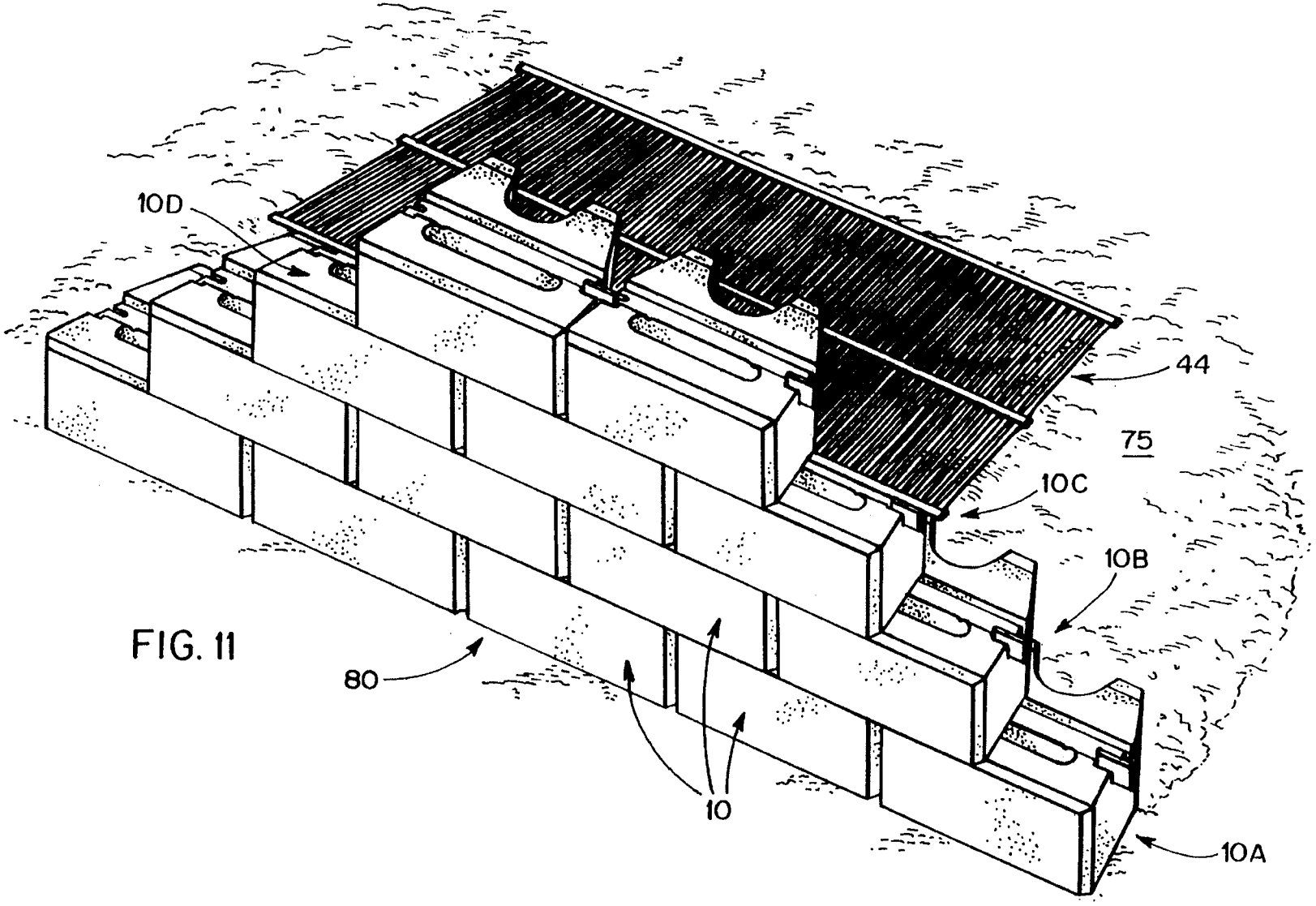
FIG. 11 is a side view similar to FIG. 6, showing a plurality of stacked courses of modular wall blocks forming a reinforced retaining wall according to the above embodiment of this invention, with a grid-like sheet of material sheet connected between selected courses of blocks by several rake grid connection devices.

Each block is positioned laterally relative to adjacent blocks in a horizontally extending row or course by virtue of connection slats 50 illustrated in FIG. 4. Aligned pairs of grooves 52,52 and 54,54 open upwardly and extend out to one of the sidewalls 14, 16 of the block 10 to selectively receive connection slats 50 which span the space between juxtaposed blocks. Grooves 52,52 and 54,54 are preferably separated by a distance of ¾ inch center to center to enable superimposed courses of blocks to have their front faces aligned vertically as seen in FIG. 11 if the forwardmost grooves 52,52 are provided with connection slats 50, or offset rearwardly by about ¾ inch if the rearwardmost grooves 54,54 are provided with the connection slats 50 as described in further detail below. The grooves have a depth of approximately 1¼ inches, a width of approximately 5/16 inch. The bottom surfaces 53, 55 respectively of the grooves 52,52 and 54,54 are slanted downwardly towards the nearest sidewall 14, 16 to allow water to drain by gravity.

The slats 50 inserted in grooves 52,52 or 54,54 include portions 56 which extend laterally from the respective sidewalls of the blocks 10 and further portions 58 which project above the block 10. The portions 56 span the space between horizontally juxtaposed blocks 10 and are engaged in corresponding grooves in juxtaposed blocks to position or locate the blocks in each course side-to-side. The upper portions 58 extend above the upper surface 28 of the block to position or locate a superimposed block in the next upper course. In this respect, an enlarged opening 60 extends through the center of each block 10 from the upper surface 28 to the lower surface 30. Superimposed blocks are staggered laterally so that the opening 60 in an upper block receives the upper portion 58 of a connector slat 50 aligning a pair of blocks in a course below. The upper block is pushed forwardly until the rearward edge 62 of the opening 60 engages the upward exposed portion 58 of a slat 50 as best seen in FIG. 8.

As indicated, two pairs of grooves 52,52 and 54,54 are spaced at different distances from the front face 12 of each block 10 to enable the selective production of a retaining wall in which the front faces 12 are either vertically aligned as seen in FIG. 11 or offset rearwardly from a successively lower course of blocks (not shown).

The sidewalls 14, 16 taper slightly inwardly from front face 12 until reaching a point beyond the trough 32, after which the portions 18, 20 taper inwardly at an angle of approximately 38°, until reaching the rear wall portions 22, 24 below flat upper surfaces 40. The arcuate cut out 26 located between rear wall portions 22, 24 saves on overall weight of the block and is useful in handling the block by providing thumb-engaging central portions 27 which cooperate with finger-engaging portions at the top of rear wall 62 of the opening 60 to facilitate lifting and placing the blocks in constructing a retaining wall.

A uniaxially stretched geogrid (or other apertured sheet-like grid-like sheet of material reinforcing means) 44 is placed on a block 10. With a uniaxial geogrid as shown, a bar 42 thereof rests on the offset portion 36 of the block 10. The grid-like sheet of material 44 is captured by the crossbar 74 of a "rake" or "comb" 70 seen best in FIG. 5. The rake 70 includes a plurality of downwardly facing fingers 72 frictionally secured in the trough 32 through the grid openings 43 defined between the bar 42 and the strands 48 of the grid-like sheet of material sheet 44. The remainder of the grid-like sheet of material 44 extends rearwardly from the block 10 into the soil or other particulate material 75.

The entirety of the rake 70, and all but very minor portions of the grid-like sheet of material 44 passing over the portions 40 of the block 10, are below the level of the upper surface 28 of the block 10. Depending on the spacing between the strands 48 of the grid-like sheet of material 44, it is possible that there will be limited portions of the grid-like sheet of material compressed between a bottom surface 30 of a superimposed block and the small flat areas 40 of the block to which the grid-like sheet of material is secured. However, this minimal frictional engagement is of little significance and would not preclude the secure engagement between the rake 70 and the modular block 10 which prevents shifting of the grid-like sheet of material during a seismic eruption.

Figure 5A:
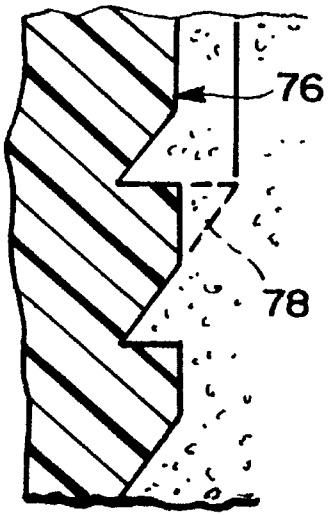
FIG. 5A is an enlarged elevational view of projections formed in a sidewall of a finger of the rake connection device shown in FIG. 5.
Figure 5:
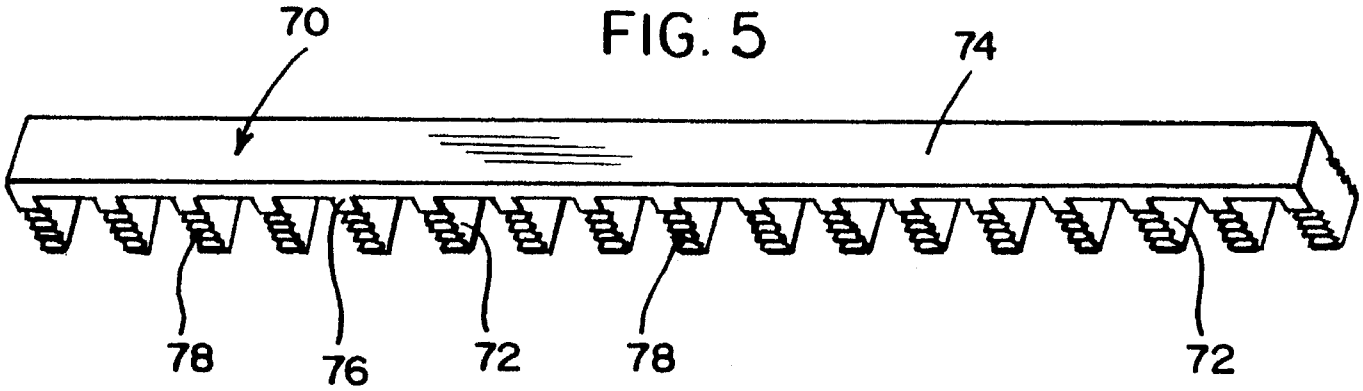
FIG. 5 is a side perspective view of one form of a rake connection device used to secure a grid-like sheet of material to a modular wall block according to the above embodiment of this invention.
Figure 6:
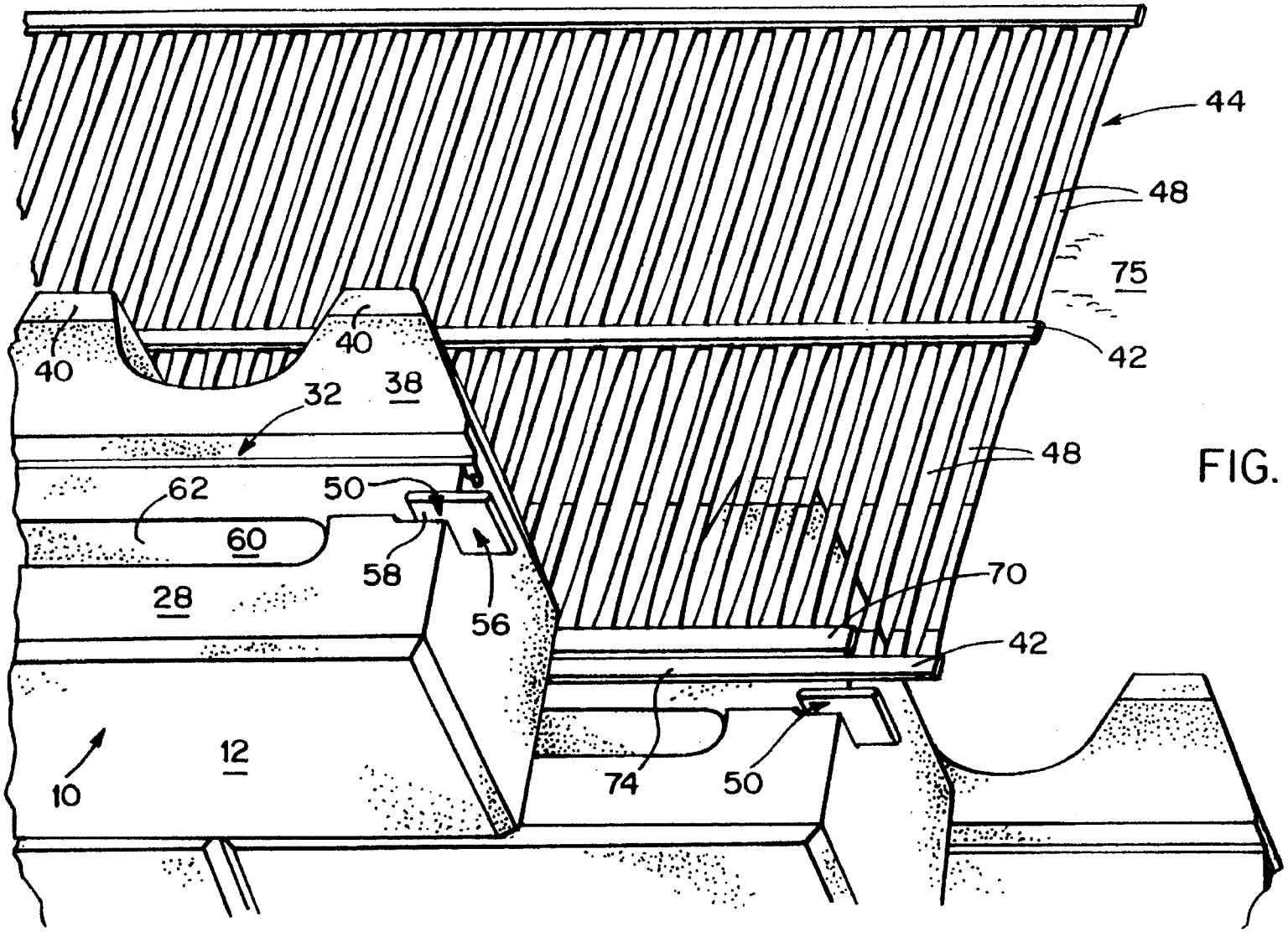
FIG. 6 is a front perspective view illustrating the manner in which a plurality of modular wall blocks are stacked in laterally staggered courses with a grid-like sheet of material secured to selected wall blocks.
Figure 7:
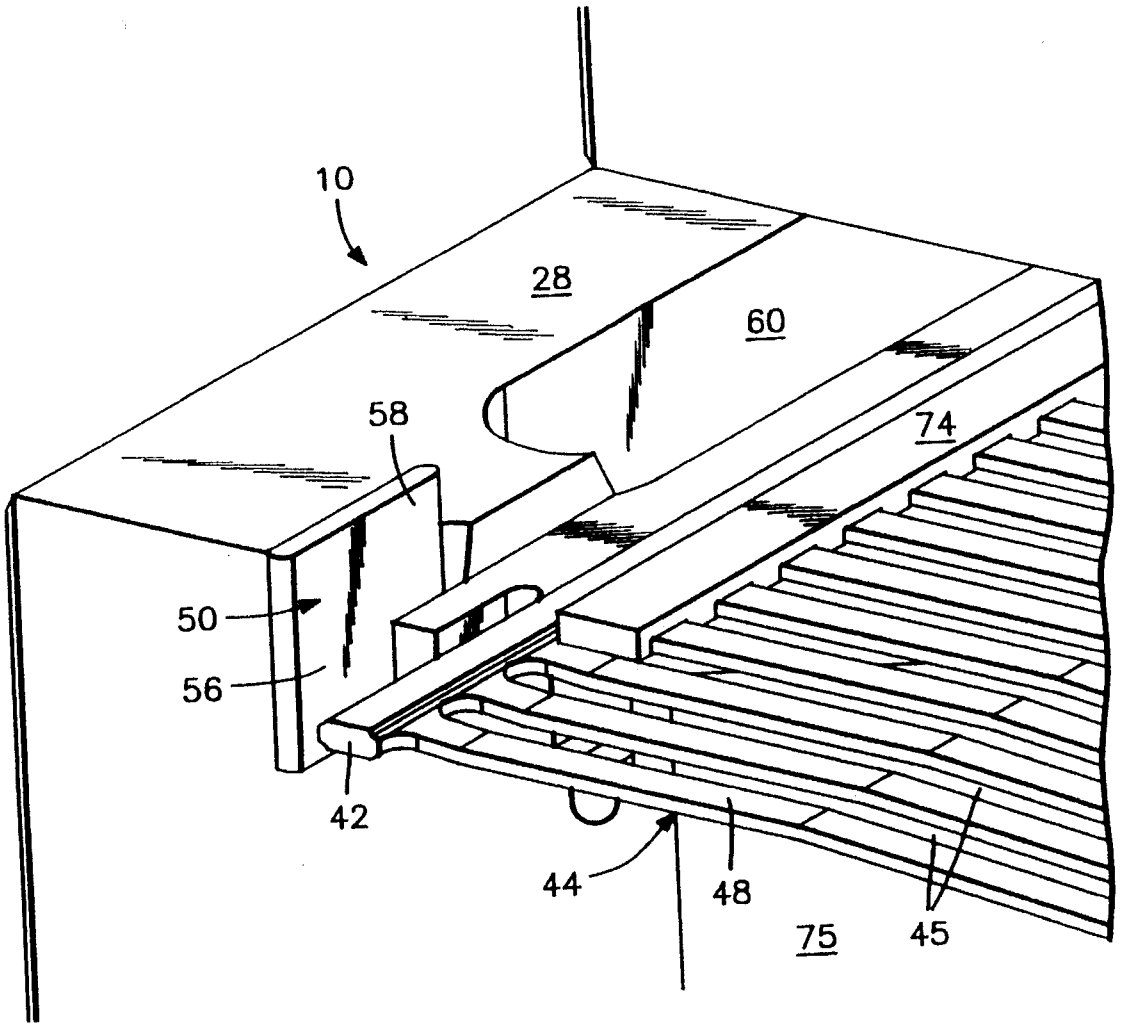
FIG. 7 is a fragmentary rear perspective view further illustrating the connection between the grid-like sheet of material and a modular block according to the above embodiment of this invention.

Details of one form of rake grid connection device 70 are shown in FIGS. 5 and 5A. The rake grid connection device 70 includes the plurality of fingers 72 extending substantially parallel to each other and interconnected at one end by the crossbar 74. The length of the crossbar 74 is preferably equal to, or less than, the length of the trough 32. As shown, the trough 32 preferably extends across the entire width of a block 10, although it could be defined by discrete recesses spaced to receive the fingers 72 of the grid connection device 70 as shown in FIG. 12. The fingers 72 of the rake grid connection device are separated by a distance designed to space them apart by a distance equal to the spacing between the grid openings 43 of the grid-like sheet of material 44, or a multiple thereof.

As shown in detail in FIG. 5A, the fingers 72 preferably include lateral sidewalls 76, which include, proceeding downwardly from crossbar 74, a plurality of spike projections 78. Spike projections 78 extend approximately 1/16 inch beyond the sidewalls 74 of the fingers 72. Each spike projection 78 has an overall height of approximately 3/16 inch. In FIG. 5A, the spike projection 78 is schematically shown engaging a sidewall 31 of trough 32. Due to the resilient nature of the material of the rake 70, the spike projections 78 are driven downwardly along the height of the sidewalls 31 of the troughs 32 for frictional engagement with the sidewalls 31. By the angle of inclination of the spike projections 78, it is possible to drive the fingers 72 downwardly into the trough 32 whereas considerable force would be required to extricate the rake 70 from the trough 32, such a force being far greater than would be expected during seismic eruptions with vertical accelerations.

The grid-like sheet of material section 44 illustrated in the drawings is representative of an extended length of grid-like sheet of material which is to be secured to a modular wall block 10 and typically measures four feet wide in the direction of the junction bars 42, and anywhere from four to twenty-five feet or more in length in the direction of the longitudinal axis of the strands 48.

In constructing a retaining wall 80 such as shown in FIG. 11 using the modular block system of the instant invention, a first course 10A of modular wall blocks is positioned side-by-side, depending upon the configuration of the wall 80. Block connection slats 50 are selectively positioned in forwardmost grooves 52,52 if a vertical wall face is to be constructed, or in rearwardmost grooves 54,54 if an offset or stepped wall is to be constructed. The slats 50 extend laterally between grooves of adjacent blocks 10 in the course 10A to align or position the blocks 10 side-by-side, with portions 58 extending upwardly beyond the upper surfaces 28 of the wall blocks 10 in the course 10A. A second course 10B of modular wall blocks 10 is then superimposed on the lower course 10A in staggered relationship. Portions 58 of the connection slats 50 which extend above the upper surface 28 of each block in the course 10A are loosely received in the openings 60 of a block in course 10B. The upper block is moved forwardly until the rear edge 62 of its opening 60 engages the connection slat 50. Thus, these elements function as a "positioning" or "locating" means to selectively vertically align or offset the front faces 12 of blocks on the course 10B from the front faces 12 of blocks in the course 10A therebelow. Further, courses 10C, 10D, etc. of blocks 10 are laid in a similar manner.

The slats 50 are approximately 7/32" to 9/32" thick, and preferably 1/4" thick, as compared to the depth of the opening 60 which is 1 1/4", front to back, approximately five times the thickness of the slat. Only 3/4" of the slat 50 extends above the upper surface of the block and into a 7 5/8" deep opening 60. The slat 50 is only 2" wide, whereas the opening 60 is at least four times that dimension. The upper block is free to move substantially, both laterally and front-to-back, regardless of the presence of the upper portion 58 of a connection slat 50 in the opening 60. Thus, the slats 50, in cooperation with the rear wall 62 of an opening 60, function to "position" or "locate" upper and lower blocks relative to each other during the construction of a retaining wall. Any interlocking of one course to another in a retaining wall utilizing the modular wall blocks system of the instant invention is primarily through the inter-engagement of the blocks and their associated reinforcing means (grid-like sheet of material) with the soil or other particulate matter.

The grooves 52,52 or 54,54 into which slats 50 are placed, are dimensioned so that the slats 50 have some play when received in the grooves. This permits a limited degree of curvature in the retaining wall, even with the slats 50 spanning the space between juxtaposed wall blocks. If even greater curvature is desired, the slats 50 can contain V-shaped grooves 90, 92 which can be made to deflect or bend such that they permit the juxtaposed blocks 10 to rotate with respect to the face 12 of the wall. Therefore, depending upon the degree of curvature of the front face of the formed retaining wall, the slats 50 will bend to span the gap between adjacent modular wall blocks.

In constructing a retaining wall 80 such as shown in FIG. 11, lengths of grid-like sheet of materials 44 may be secured to selected wall blocks 10 by a rake grid connection device 70 as described above before laying upper blocks thereon. The grid-like sheet of material 44 may extend across a width involving a plurality of modular blocks 10. For each modular block 10 to which a section of grid-like sheet of material 44 is secured, a separate rake grid connection device 70 is preferably used to facilitate the construction process and create a positive mechanical connection.

The area behind the rear faces 22, 24 of the blocks 10 is progressively backfilled with soil or other aggregate 75 as the courses are laid to secure the extended lengths of grid-like sheet of material sections 44 within the fill material 75. The grid-like sheet of material 44 functions to reinforce the fill 75 and thereby create a contiguous mass in a well known manner.

In an alternative embodiment of the wall block from that shown in FIGS. 1–3, FIG. 12 depicts a similar wall block to that shown in FIG. 1 with similar items using the same reference numbers as used in FIG. 1 but with a prime designation. In addition, as will be noted, the trough or recess 32 of FIG. 1 is replaced by a plurality of spaced holes or recesses 32' which are spaced to extend transversely across block 10' between sides 14' and 16', below its upper surface 28' to receive the individual fingers of a rake grid connection device. Holes or recesses 32' are circular for receipt of cylindrical fingers of a comb. The cylindrical fingers would include serrations extending about a periphery of the fingers. Each recess 32' is about ⅞ inch deep, about ¾ inch in diameter. Alternatively, the holes or recesses 32' may be of any shape, it being understood that the fingers of the comb would be of a similar consistent shape to fit into the holes or recesses 32'.

In a further alternative embodiment of the wall block from that shown in FIGS. 1–3 and in FIG. 12, FIGS. 13–15 depict a similar wall block to that shown in FIG. 1, with similar portions using the same reference numbers as in FIG. 1 but with a double prime designation. In addition, as will be noted, the wall block 10" of FIGS. 14 and 15 includes a slot 102 which extends transversely across block 10" between sides 14" and 16" at its bottom surface 30".

The slot 102 is 1.625 inches wide and one inch deep. A rear wall 104 of the slot 102 is located 4.5625 inches from rear wall portions 22", 24". The slot 102 is formed by the use of a core puller device incorporated into the high-speed production process described herein above. The core puller device includes a frame which carries a hydraulically actuated bar and which is mounted on a block machine. This bar is cycled with the block machine and creates the core or slot on the bottom of the wall block. In the wall block 10" according to a preferred embodiment of this invention, the slot provides the ability to use a grid retention device mounted in the top of the block for a positive geogrid connection device as well as a block location device, as will be explained in more detail with reference to FIGS. 18–20.

Each modular wall block 10" includes a trough or recess 32" which preferably extends transversely across each block 10" below its upper surface 28" to frictionally receive a rack grid connection device. Forwardly of the trough 32" is an offset portion 36". Rearwardly of the trough 32" are upwardly inclined portions 38" which extends to two small flat areas 40". The offset portion 36" is preferably positioned below the upper surface 28" by approximately ⅜ of an inch to receive a thickened bar 42" of a uniaxial geogrid or the like 44". Thus, as in modular wall block 10, only a nominal portion of the geogrid is engaged between upper and lower courses of wallblock 10" the portions of strands 48" passing over the flat upper surface areas 40" and engaged by the lower cementitious surface of an upper modular wall block 10".

Figure 14:
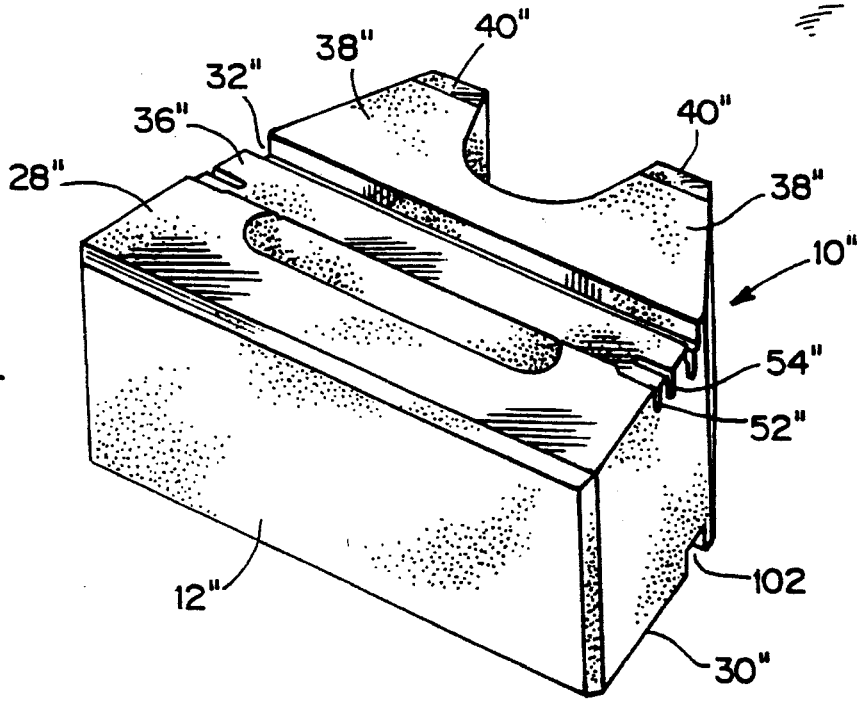
FIG. 14 is a front perspective view of a preferred form of a modular wall block according to the further alternate embodiment of the instant inventive concepts.
Figures 15, 16, 17, 18:
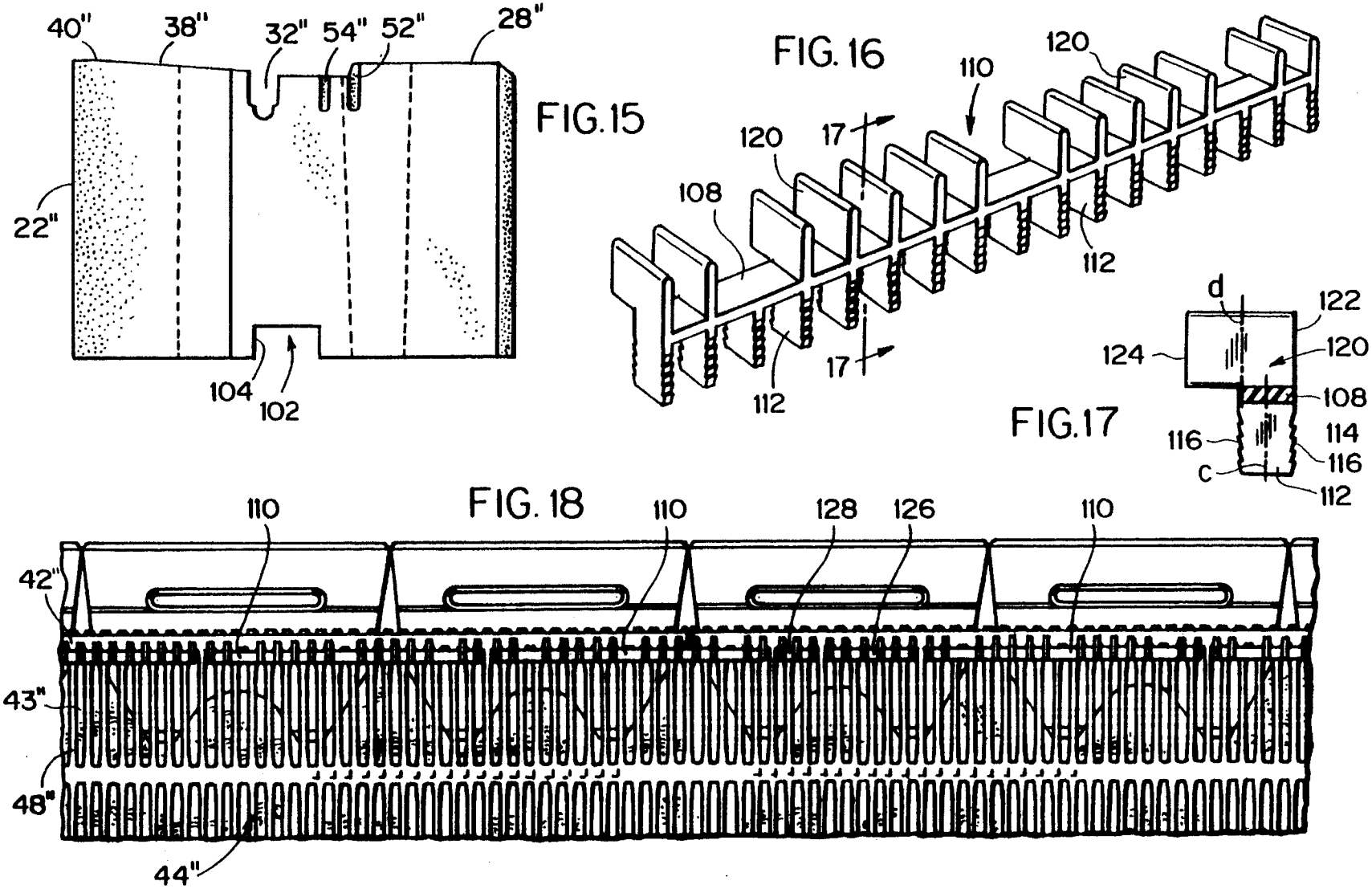
FIG. 15 is a side elevational view thereof.
FIG. 16 is a front perspective view of a preferred form of a rake connection device used to secure a grid-like sheet of material to a modular wall block according to the further alternate embodiment of this invention.
FIG. 17 is a sectional view taken along line 17—17 of FIG. 16.
FIG. 18 is a plan view of a connection of a grid-like sheet of material to a course of modular wall blocks according to the further alternate embodiment of this invention.

As an alternative means of connecting adjacent blocks in a horizontally extending row or course, the modular block 10" may include grooves 52", 52" and 54", 54" as shown in FIGS. 14 and 15 to receive slats (not shown) such as the elements 50 discussed above with respect to the embodiments of FIGS. 1–12. However, the grooves 52", 52" and 54", 54" may be omitted from the modular wall block 10".

Figure 19:
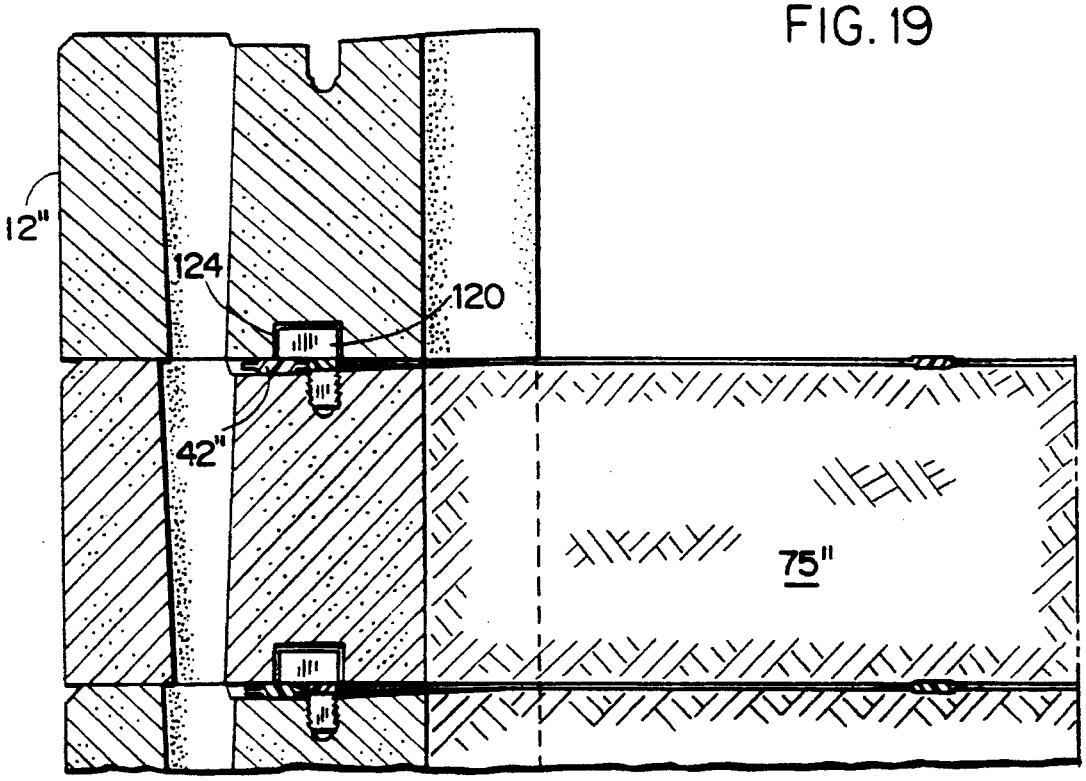
FIG. 19 is a side sectional view taken along line 19—19 of FIG. 13 showing the manner in which a pair of superimposed wall blocks are positioned vertically relative to each other and the manner in which a grid-like sheet of material is secured to the wall blocks.
Figure 20:
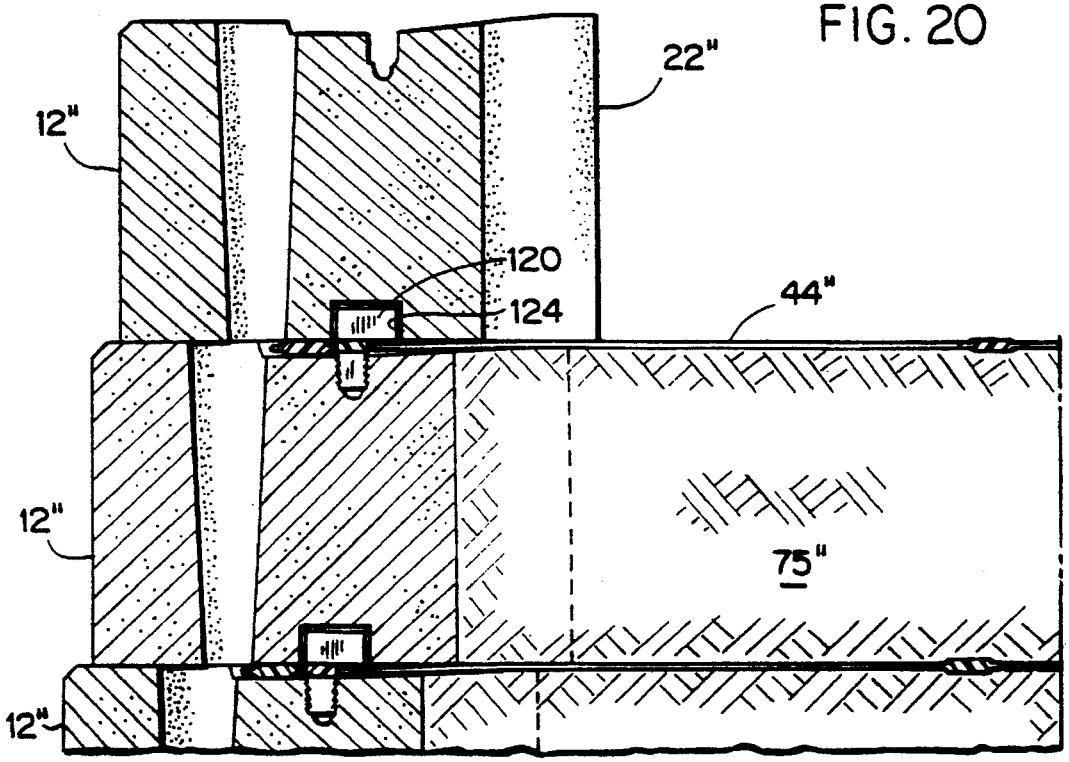
FIG. 20 is a side sectional view similar to FIG. 19, but with the rake connection device reversed so that an upper course of wall blocks are shifted rearwardly to vertically stagger the front faces of superimposed courses of wall blocks with respect to each other.

A uniaxially stretched geogrid (or other apertured sheet-like grid-like sheet of material reinforcing means) 44" is placed on a block 10". With a uniaxial geogrid as shown, a bar 42" thereof rests on the offset portion 36" of the block 10". The grid-like sheet of material 44" is captured by a spine 108 of a "rack" or "comb" 110 seen best in FIG. 16. The rack 110 includes a plurality of downwardly facing fingers 112 to be frictionally secured in the trough 32" through the grid openings 43" defined between the bar 42" and the strands 48" of the grid-like sheet of material 44". The remainder of the grid-like sheet of material 44" extends rearwardly from the block 10" into the soil or other particulate material 75" as shown in FIGS. 19 and 20.

Details of the preferred rake grid connection device are shown in FIGS. 16 and 17. The rake grid connection device 110 includes the plurality of fingers 112 extending substantially parallel to each other. The device 110 may be made of plastic or fiberglass reinforced plastic, for example.

The fingers 112 have a central axis "c". One end of each finger 112 is interconnected by spine 108. The length of the spine 108 is preferably equal to, or less than the length of the trough 32". The fingers 112 of the rack grid connection device are separated by a distance designed to space them apart by a distance equal to the spacings between the grid openings 43" of the grid-like sheet of material 44", or a multiple thereof.

As shown in detail in FIG. 17, the fingers 112, preferably include lateral sidewalls 114, which include, proceeding downwardly from spine 108, a plurality of spike projections 116. The width of the fingers 112 from the outermost extremities of opposed spike projections 116, is preferably about 0.75 inches.

By the angle of inclination of the spike projection 116, it is possible to drive the fingers 112 downwardly into the trough 32" whereas considerable force would be required to extricate the rake 110 from the trough 32", such a force being far greater than would be expected during seismic eruptions with vertical accelerations.

Spaced across the spine 108 on a side of the spine opposite to that of the downwardly projecting fingers are upwardly extending locating tabs 120. Tabs 120 include central axis "d" spaced from central axis "c" of fingers 112. The tabs preferably extend above the spine in alignment with the downwardly projecting fingers 112 with a tab 120 projecting above, preferably, a majority of the fingers 112. It also contemplated as being within the scope of the present invention that the tabs 120 are not in alignment with the fingers or that the tabs 120 form a single bar connected to an upper end of the fingers, thereby avoiding the need for spine 108.

The absence of tabs 120, above a corresponding downwardly projecting finger 112 may be necessitated for a proper formation of the comb 110. However, it is considered as being within the scope of the present invention that a corresponding number of tabs 120 could be provided for each finger 112.

The tabs 120, in a preferred embodiment, include one lateral edge 122 in alignment with one lateral edge of a corresponding finger 112. It is also possible that lateral edge 122 is offset inwardly or outwardly from a lateral edge of a finger 112. However, an opposite lateral edge 124 of the tab 120 projects beyond the other lateral edge of the finger 112 by a distance of approximately 0.6 inches. This relationship may be defined by central axis "c" of the fingers being offset from central axis "d" of the tabs.

Preferably, an overall width of the tab 120 is 1.375 inches. In combination, the height of the rack from the top of the tab 120 to the bottom of the finger 112 is approximately 2.125 inches.

Figure 13:
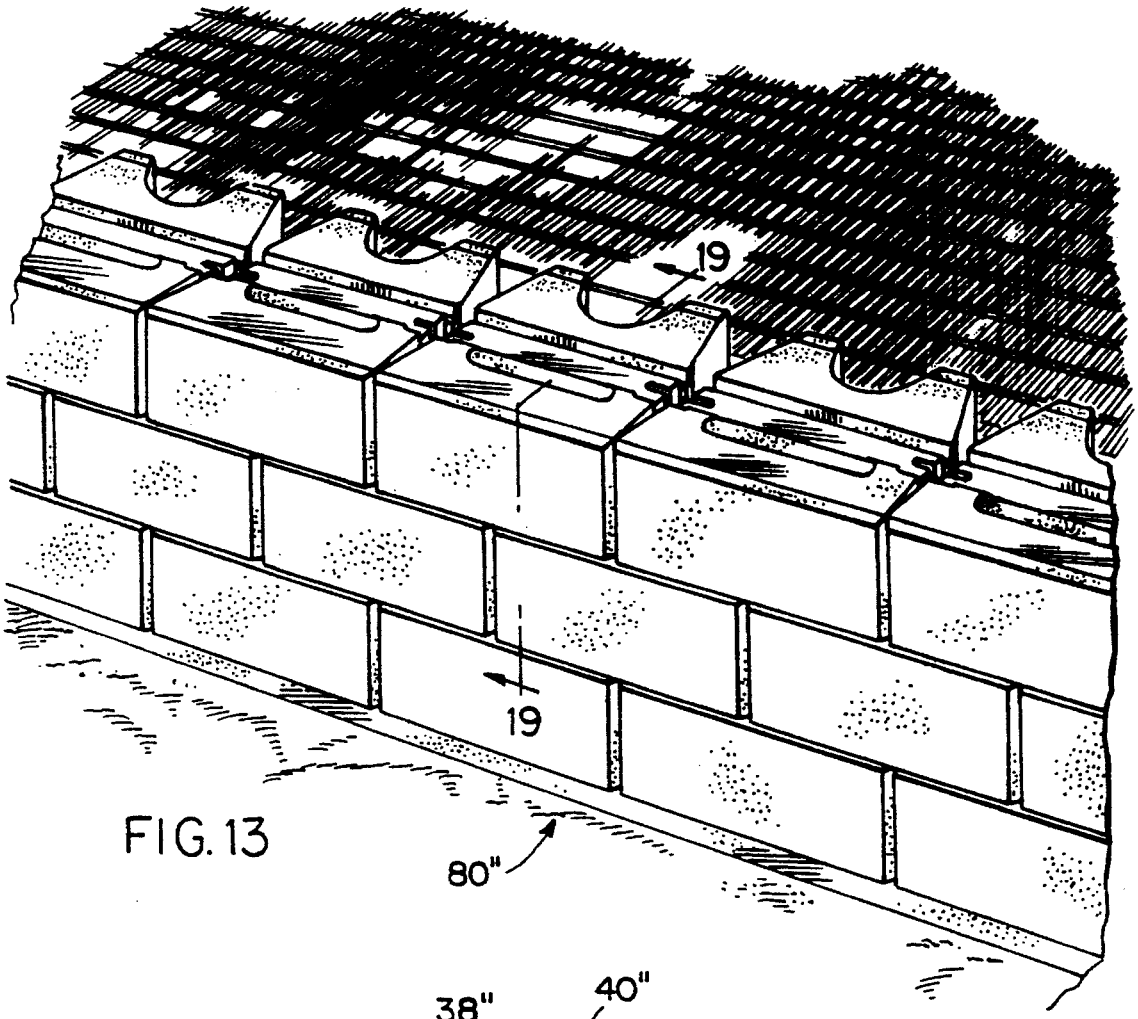
FIG. 13 is a side view showing a plurality of stacked courses of modular well blocks forming a reinforced retaining wall according to a further alternate embodiment of this invention, with a grid-like sheet of material sheet connected between selected courses of blocks.

In constructing a retaining wall 80" such as is shown in FIG. 13, using the modular wall block 10" shown in FIG. 14, a first course of modular wall blocks is positioned side by side as shown in FIG. 18. A plurality of rack grid connection devices 110 are shown secured in troughs 32" with the fingers 112 of each grid connection device 110 extending through an aperture 43" of the geogrid 44". In securing adjacent modular wall blocks in a horizontal course, each grid connection device 110 overlaps an adjacent modular wall block, preferably by securing at least three fingers 112 in a trough 32" of the adjacent wall block. In gaps formed between adjacent grid connection devices 110 which are of a length less than a complete grid connection device as shown in FIG. 16, the grid connection device 110 may be broken into smaller segments such as are shown by segments 126, 128 in FIG. 18. It is desirable that when a grid connection device extends between adjacent wall blocks that at least three fingers of a complete or partial grid connection device be secured in each wall block to lock the wall blocks side to side and secure geogrid that may span adjacent wall blocks.

In positioning a successively higher course of wall blocks, the direction of extension of the tabs 120 of the grid connection device 110 selectively aligns the front faces 12" of the successive courses in a vertically aligned or vertically staggered orientation. As shown in FIG. 19, when the edge 124 of the tab 120 is positioned towards the front face 12" of the modular wall block, the tabs 120 are received in the slot 102 located at the bottom of a successively higher course of wall blocks to position the front faces 12" of successive courses of wall blocks in a vertically aligned orientation. However, when the lateral edge 124 of tab 120 is placed to extend towards rear face 22" of the wall block 10", the front faces 12" of successive courses of wall blocks are positioned in a vertically staggered orientation. This is accomplished due to the offset of the central axes of the tabs and the fingers.

As is usual and customary in the industry in the construction of a retaining wall, after the laying of several courses of wall blocks, the courses are shimmed to be level to accommodate any variances from acceptable tolerances in the construction of the wall blocks. Accordingly, the width of the slot 102 is intended to be approximately ¼ of an inch wider than the width of the tab 120 to allow some play in the positioning of a successively higher course of modular wall blocks. The difference in width between the slot 102 and the tab 120, also allows for some degree of curvature of a retaining wall having a radius of curvature of greater than 60 feet. It is understood as being within the scope of the present invention to increase the width of the slot 102 if a lesser minimum radius of curvature is desired. Also, if a lesser minimum radius of curvature is required, it is possible to position the rack connection device 110 entirely within the sidewalls of each modular wall block and to use the slat connectors in the grooves 52", 54" as is done with reference to FIGS. 1–12.

Having described the invention, many modifications thereto will become apparent to those skilled in the art to which it pertains without deviation from the spirit of the invention as defined by the scope of the appended claims.

What is claimed is:

1. A modular wall block system to be used for forming a retaining wall, said modular wall block system comprising:

a plurality of wall blocks each having a front face for forming a portion of an exterior surface of the retaining wall, a rear face, upper and lower surfaces, and opposed sidewalls extending between said upper and lower surfaces and said front and rear faces, a grid-like sheet of material comprising end portions to be secured to selected wall blocks with the remainder of the grid-like sheet of material extending rearwardly into fill material behind the retaining wall to reinforce the retaining wall, said end portions of said grid-like sheet of material defining a plurality of laterally spaced openings, a grid connector for securing said end portions of said grid-like sheet of material to said selected wall blocks and connecting and positioning adjacent wall blocks relative to each other, said grid connector comprising a spine and a plurality of finger members and at least one tab extending therefrom, a central axis of said finger members being spaced from a central axis of said at least one tab, said finger members being spaced apart by a distance corresponding to the spacing between selected openings in said end portions of said grid-like sheet of material, and a recess defined in each of said wall blocks below said upper surface thereof, said recess being dimensioned to frictionally receive and retain said finger members of said grid connector with said spine of said grid connector overlying said end portions of said grid-like sheet of material to secure said end portions of said grid-like sheet of material to said selected wall blocks, said at least one tab projecting above said upper surfaces of said wall blocks, said wall blocks each including a slot extending in said lower surfaces thereof, said slot in an upper wall block receiving said at least one tab of said grid connector in a lower wall block with a surface defining said slot engaging said at least one tab of said grid connector to position said front faces of said wall blocks in superimposed courses of wall blocks relative to each other in one of a vertically aligned and vertically staggered orientation dependent upon a direction of positioning of said at least one tab.

2. A modular wall block system as claimed in claim 1, wherein said slot extends between said opposed sidewalls of said wall block.

3. A modular wall block system as claimed in claim 1, wherein said grid connector includes portions projecting laterally beyond said sidewalls of said wall blocks to span the space between sidewalls of adjacent wall blocks in a course of wall blocks and engage said recess of an adjacent wall block to position juxtaposed wall blocks in said course of wall blocks relative to each other.

4. A modular wall block system as claimed in claim 1, wherein said finger members of said grid connector include serrations to frictionally secure said finger members in said recess.

5. A modular wall block system as claimed in claim 4, wherein said grid connector is made of plastic.

6. A modular wall block system as claimed in claim 4, wherein said grid connector is made of fiberglass reinforced plastic.

7. A modular wall block system as claimed in claim 1, wherein said slot includes substantially parallel sidewalls and serrations of said finger members frictionally engage said sidewalls.

8. A modular wall block system as claimed in claim 1, wherein said recess is defined by a continuous recess extending across said wall block between said opposed sidewalls.

9. A modular wall block system as claimed in claim 1, wherein the length of the spine of said grid connector is less than or equal to the distance between said opposed sidewalls of said wall blocks.

10. A retaining wall comprising:

a plurality of courses of superimposed wall blocks, each course including a plurality of modular wall blocks each of which has a front face forming a portion of an exterior surface of the retaining wall, a rear face, upper and lower surfaces, and opposed sidewalls extending between said upper and lower surfaces and said front and rear faces, a grid-like sheet of material comprising end portions secured to selected wall blocks with the remainder of the grid-like sheet of material extending rearwardly therefrom, said end portions of said grid-like sheet of material defining a plurality of laterally spaced openings, a grid connector securing said end portions of said grid-like sheet of material to said selected wall blocks and for connecting and positioning adjacent wall blocks relative to each other, said grid connector comprising a spine and a plurality of finger members and tabs extending therefrom, a central axis of said finger members being spaced from a central axis of said tabs, said finger members being spaced apart by a distance corresponding to the spacing between selected openings in said end portions of said grid-like sheet of material and passing through said openings, a recess defined in each of said wall blocks below said upper surface thereof, said recess frictionally receiving and retaining said finger members of said grid connector with said spine of said grid connector overlying said end portions of said grid-like sheet of material to secure said end portions of said grid-like sheet of material to said selected wall blocks, and fill material behind said wall blocks, portions of said grid-like sheet of material being embedded in said fill material, said tabs projecting above said upper surfaces of said wall blocks, said wall blocks each including a slot extending in said lower surfaces thereof, said slot in an upper wall block receiving said tabs of said grid connector in a lower wall block with a surface defining said slot engaging said tabs of said grid connector to position said front faces of said wall blocks in superimposed courses of wall blocks relative to each other in one of a vertically aligned and vertically staggered orientation dependent upon a direction of positioning of said tabs.

11. A retaining wall as claimed in claim 10, wherein each of said wall blocks includes a groove of said recess, said grid connector being selectively seated in said groove to vertically align said front faces of wall blocks in superimposed courses of wall blocks with each other.

12. A retaining wall as claimed in claim 11, wherein said groove of said recess includes substantially parallel sidewalls and serrations of said finger members frictionally engage said sidewalls.

13. A retaining wall as claimed in claim 10, wherein each of said wall blocks includes a groove of said recess, said grid connector being selectively seated in said groove to rearwardly offset said front faces of wall blocks in superimposed courses of wall blocks relative to each other.

14. A retaining wall as claimed in claim 10, wherein said grid connector includes portions projecting laterally beyond said sidewalls of said wall blocks spanning the space between sidewalls of adjacent wall blocks in a course of wall blocks and engage said recess of an adjacent wall block to position juxtaposed wall blocks in said course of wall blocks relative to each other.

15. A retaining wall as claimed in claim 10, wherein said finger members of said grid connector include serrations which frictionally secure said finger members in said recess.

16. A retaining wall as claimed in claim 15, wherein said grid connector is made of plastic.

17. A retaining wall as claimed in claim 15, wherein said grid connector is made of fiberglass reinforced plastic.

18. A retaining wall as claimed in claim 10, wherein said recess is defined by a continuous recess extending across said wall block between said opposed sidewalls.

19. A retaining wall as claimed in claim 10, wherein the length of the spine of said grid connector is less than or equal to the distance between said opposed sidewalls of said wall blocks.

20. A modular wall block system to be used for forming a retaining wall, said modular wall block system comprising:

a plurality of wall blocks each having a front face for forming a portion of an exterior surface of the retaining wall, a rear face, upper and lower surfaces, and opposed sidewalls extending between said upper and lower surfaces and said front and rear faces, a positioning device for locating juxtaposed wall blocks relative to each other in the retaining wall, a tab of said positioning device projecting above said upper surfaces of said wall blocks, said wall blocks each including portions defining a slot extending to said lower surfaces thereof, said slot in an upper wall block receiving said tab of said positioning device in a lower wall block with a surface defining said slot engaging said tab of said positioning device to position wall blocks in superimposed courses of wall blocks relative to each other, and further portions of said positioning device projecting laterally beyond said sidewalls of said wall blocks to span the space between sidewalls of adjacent wall blocks in a course of wall blocks to position juxtaposed wall blocks in said course of wall blocks relative to each other.

21. A modular wall block system as claimed in claim 20, wherein each of said wall blocks includes portions defining a groove extending inwardly from said opposed sidewalls and opening to said upper surface, said tab of said positioning device projecting above said upper surface of said block for reception in said slot defined in the lower surface of a wall block superimposed thereon so as to position wall blocks in superimposed courses of the retaining wall relative to each other in one of a vertically aligned and vertically offset orientation, said connector device further including portions projecting laterally beyond said sidewalls of said wall blocks to span the space between adjacent wall blocks in a course of wall blocks to position juxtaposed wall blocks in said course of wall blocks relative to each other.

22. A retaining wall comprising:

a plurality of courses of superimposed wall blocks, each course including a plurality of modular wall blocks each of which has a front face for forming a portion of an exterior surface of the retaining wall, a rear face, upper and lower surfaces, and opposed sidewalls extending between said upper and lower surfaces and said front and rear faces, a positioning device positioning juxtaposed wall blocks relative to each other in the retaining wall, tabs of said positioning device projecting above said upper surfaces of said wall blocks, said wall blocks each including portions defining a slot extending to said lower surfaces thereof, said slot in an upper wall block receiving said tabs of said positioning device in a lower wall block with a surface defining said slot engaging said tabs of said positioning device to position wall blocks in superimposed courses of wall blocks relative to each other in one of a vertically aligned and vertically offset orientation, and further portions of said positioning device projecting laterally beyond said sidewalls of said wall blocks spanning the space between sidewalls of adjacent wall blocks in a course of wall blocks to position juxtaposed wall blocks in said course of wall blocks relative to each other.

23. A retaining wall as claimed in claim 22, wherein each of said wall blocks includes portions defining a groove extending inwardly from said opposed sidewalls and opening to said upper surface, said positioning device being seated in said groove.

24. A modular wall block comprising:

a front face, a rear face, an upper surface, a lower surface, and opposed sidewalls extending between said upper and lower surfaces and said front and rear faces, a recess defined below a level of said upper surface for receiving a grid connector for connecting a grid-like sheet of material to said modular wall block, said recess of said upper surface and a recess of an adjacent wall block receiving said grid connector for positioning adjacent wall blocks in a course of wall blocks with respect to each other, and a slot defined in said lower surface cooperating with said grid connector received in said recess for positioning superimposed course of wall blocks with respect to a lower course of wall blocks in one of a vertically aligned and vertically offset orientation.

25. A modular wall block as claimed in claim 24, wherein said rear face includes an arcuate cut out portion extending towards said front face.

26. A modular wall block as claimed in claim 24, wherein said recess extends continuously between said opposed sidewalls.

27. A modular wall block as claimed in claim 24, wherein the rearward portion of said upper surface is inclined upwardly from said recess toward said rear face.

28. A modular wall block as claimed in claim 24, wherein said opposed sidewalls converge toward each other from said front face to said rear face.

29. A modular wall block system to be used for forming a retaining wall, said modular wall block system comprising:

a plurality of wall blocks each having a front face for forming a portion of an exterior surface of the retaining wall, a rear face, upper and lower surfaces, and opposed sidewalls extending between said upper and lower surfaces and said front and rear faces, a grid-like sheet of material comprising end portions to be secured to selected wall blocks with the remainder of the grid-like sheet of material extending rearwardly into fill material behind the retaining wall to reinforce the retaining wall, said end portions of said grid-like sheet of material including a plurality of elongated strands extending generally parallel to said front face of said blocks interconnected by a multiplicity of rearwardly extending elongated strands together defining a plurality of laterally spaced openings, a grid connector for securing said end portions of said grid-like sheet of material to said selected wall blocks, said grid connector comprising a crossbar and a plurality of finger members integrally extending therefrom, said finger members being spaced apart by a distance corresponding to the spacing between selected openings in said end portions of said grid-like sheet of material, and an elongated recess defined in each of said wall blocks below said upper surface thereof, said recess being dimensioned to receive said fingers of said grid connector with said crossbar of said grid connector overlying a plurality of said rearwardly extending strands of said grid-like sheet of material to secure said end portions of said grid-like sheet of material to said selected wall blocks.

30. A modular wall block system as claimed in claim 29, wherein said crossbar overlies substantially all of said rearwardly extending strands.

31. A locating device for positioning front faces of wall blocks in superimposed courses of wall blocks relative to each other in one of a vertically aligned and vertically staggered orientation, said locating device comprising:

a spine, a plurality of finger members extending from said spine in one direction and collectively defining a plane, at least one tab extending from said spine in an opposite direction and at least a portion of said tab being in said plane of said finger members, and a central axis of said finger members being laterally spaced from a central axis of said at least one tab.

32. A locating device as claimed in claim 31, wherein a side edge of said plurality of finger members and a side edge of said at least one tab lie in a single plane.

33. A locating device as claimed in claim 31, wherein said finger members include serrations.

34. A locating device as claimed in claim 31, wherein said spine, said finger members and said at least one tab are integrally made of plastic.

35. A locating device for positioning front faces of wall blocks in superimposed courses of wall blocks relative to each other in one of a vertically aligned and vertically staggered orientation, said locating device comprising:

a spine having a top surface, a bottom surface and opposed side edges, a plurality of finger members extending from said bottom surface in one direction and collectively defining a plane, and at least one tab extending from said top surface in an opposite direction and at least a portion of said tab projecting in said plane of said finger members so that a central axis of said at least one tab is laterally offset from a central axis of said finger members.

36. A locating device as claimed in claim 35, wherein opposed sides of said finger members are aligned with said opposed side edges of said spine.

37. A locating device as claimed in claim 35, wherein said finger members include serrations.

38. A locating device as claimed in claim 35, wherein said spine, said finger members and said at least one tab are integrally made of plastic.

39. A locating device for positioning front faces of wall blocks in superimposed courses of wall blocks relative to each other in one of a vertically aligned and vertically staggered orientation, said locating device comprising:

a plurality of finger members, at least one tab assembly connecting said finger members together and projecting at least in a plane of said finger members, and a central axis of said finger members being laterally spaced from a central axis of said at least one tab assembly.

40. A locating device for positioning front faces of wall blocks in superimposed courses of wall blocks relative to each other in one of a vertically aligned and vertically staggered orientation, said locating device comprising:

a first portion including a plurality of finger members extending in one direction and collectively defining a plane, said first portion having a central axis, and a second portion including at least one tab assembly extending from said first portion in an opposite direction and at least a portion of said second portion being in said plane of said finger members, said second portion having a central axis, said central axis of said first portion being laterally offset from a central axis of said second portion.

41. A modular wall block comprising:

a front face, a rear face, an upper surface, a lower surface, opposed sidewalls extending between said upper and lower surfaces and said front and rear faces, a continuous recess defined in said upper surface extending across the wall block between said opposed sidewalls, said continuous recess having a front edge and a rear edge, a slot defined in said lower surface having a front edge and a rear edge, a distance between said front face and said front edge of said recess being one of equal to and different from a distance between said front face and said front edge of said slot, and a distance between said front face and said rear edge of said recess being the other of equal to and different from a distance between said front face and said rear edge of said slot.

* * * * *